US010190257B2

(12) United States Patent
Lauer

(10) Patent No.: US 10,190,257 B2
(45) Date of Patent: Jan. 29, 2019

(54) WIRE CABLE AND METHOD AND DEVICE FOR PRODUCTION OF SAID WIRE CABLE

(71) Applicant: CASAR Drahtseilwerk Saar GmbH, Kirkel (DE)

(72) Inventor: Bruno Lauer, Marpingen (DE)

(73) Assignee: CASAR DRAHTSEILWERK SAAR GMBH, Kirkel (DE)

( * ) Notice: Subject to any disclaimer, the term of this patent is extended or adjusted under 35 U.S.C. 154(b) by 507 days.

(21) Appl. No.: 14/654,719

(22) PCT Filed: Dec. 17, 2013

(86) PCT No.: PCT/DE2013/100424

§ 371 (c)(1),
(2) Date: Jun. 22, 2015

(87) PCT Pub. No.: WO2014/094736

PCT Pub. Date: Jun. 26, 2014

(65) Prior Publication Data

US 2015/0315742 A1 Nov. 5, 2015

(30) Foreign Application Priority Data

Dec. 21, 2012 (DE) ..... 10 2012 112 911

(51) Int. Cl.
*D07B 5/00* (2006.01)
*D07B 1/06* (2006.01)
(Continued)

(52) U.S. Cl.
CPC ..... *D07B 5/007* (2013.01); *D07B 1/0693* (2013.01); *D07B 1/165* (2013.01); *D07B 5/00* (2013.01);
(Continued)

(58) Field of Classification Search
CPC ..... D07B 1/0693; D07B 1/165; D07B 5/00; D07B 5/007; D07B 7/02; D07B 7/027
See application file for complete search history.

(56) References Cited

U.S. PATENT DOCUMENTS 2,006,174 A 6/1935 Morin
3,083,817 A * 4/1963 Campbell ..... B21C 1/02 29/505
(Continued)

FOREIGN PATENT DOCUMENTS

AT 3819867 B 12/1986
AT 401275 B 7/1996
(Continued)

OTHER PUBLICATIONS

Roland Verreet ,, Stahldrahtseile fur Krane, 2004, XP055269147,
(Continued)

*Primary Examiner* — Shaun R Hurley
(74) *Attorney, Agent, or Firm* — Lucas & Mercanti, LLP; Klaus P. Stoffel

(57) ABSTRACT

A wire cable and a device and method for producing the wire cable, wherein a core strand is compacted and then braid strands are stranded on the core strand. The core strand is hammered before stranding of the braid strands in order to smooth the surface thereof. A plastic layer is applied to the core strand before stranding of the braid strands. The braid strands are pressed into the plastic layer while the plastic layer is heated. The core strand is a core cable and the braid strands are strands of the wire cable or the core strand is a heart strand and the braid strands are outer core strands of a core cable of the wire cable. A greater breaking strength of the wire cable is obtained by hammering the core strand in order to smooth it than by compacting a core strand with a roller compressor.

5 Claims, 2 Drawing Sheets

(51) Int. Cl.
*D07B 7/02* (2006.01)
*D07B 1/16* (2006.01)

(52) U.S. Cl.
CPC ..... *D07B 7/02* (2013.01); *D07B 7/027* (2013.01); *D07B 1/0686* (2013.01); *D07B 2201/102* (2013.01); *D07B 2201/1016* (2013.01); *D07B 2201/1036* (2013.01); *D07B 2201/1064* (2013.01); *D07B 2201/2048* (2013.01); *D07B 2201/2067* (2013.01); *D07B 2207/4059* (2013.01)

(56) References Cited

U.S. PATENT DOCUMENTS 3,149,509 A * 9/1964 Oquist ..... B21J 7/145 72/402
3,280,544 A 10/1966 Gilmore
3,444,684 A 5/1969 Schoerner et al.
4,311,001 A * 1/1982 Glushko ..... D07B 1/0693 57/138
4,454,708 A 6/1984 Verreet
4,523,445 A * 6/1985 Yoshida ..... B21J 7/16 72/342.8
4,778,246 A * 10/1988 Carroll ..... D07B 1/068 174/115
2006/0032661 A1* 2/2006 Gai ..... D07B 1/0693 174/128.1
2007/0036974 A1 2/2007 Verreet
2014/0069074 A1* 3/2014 Lauer ..... D07B 5/00 57/232
2014/0260174 A1* 9/2014 Cavallin ..... D07B 1/0686 57/215

FOREIGN PATENT DOCUMENTS

CA 1324038 C 11/1993
CH 688591 A5 11/1997
CN 1208793 A 2/1999
DE 3117452 A1 11/1982
DE 3203504 A1 11/1982
DE 4316035 A1 11/1994
DE 9319648 U1 4/1995
DE 10310855 A1 9/2004
DE 102004047077 A1 4/2006
EP 0064258 A1 11/1982
EP 0896087 A1 2/1999
EP 1160374 A2 12/2001

OTHER PUBLICATIONS

"Collection of Works in National Seminar on Further Processing Technology of Wires", The Chinese Society for Metals, pp. 209-2010, Jun. 30, 2005.

* cited by examiner

WIRE CABLE AND METHOD AND DEVICE FOR PRODUCTION OF SAID WIRE CABLE

The present application is a 371 of International application PCT/DE2013/100424, filed Dec,. 17, 2013, which claims priority of DE 10 2012 112 911.8, filed Dec. 21, 2012, the priority of these applications is hereby claimed and these applications are incorporated herein by reference.

BACKGROUND OF THE INVENTION

The invention pertains to a method for the production of a wire cable, in which a core strand is compacted and then multiwire strands are twisted onto the core strand. The invention also pertains to wire cable obtainable by means of this method and to a device for the production of the wire cable.

A method is this type is already known from use. Before a wire cable is produced by twisting multiwire strands onto a core cable, the core cable is compacted by means of a roll compactor to increase the density of the wire cable.

SUMMARY OF THE INVENTION

The invention is based on the goal of making it possible to produce a wire cable with increased breaking strength.

According to the invention, this goal is achieved in that the core strand is hammered to smooth its surface before the multiwire strands are twisted onto it.

In the especially preferred embodiment of the invention, the core strand is formed by a core cable of the wire cable, and the multiwire strands are the multiwire strands of the wire cable. Alternatively, the core strand can also be formed by a multiwire heart strand of a core cable of the wire cable, and the multiwire strands can be formed by outer multiwire core strands of the core cable. To produce the wire cable, furthermore, both the multiwire heart strand and the core cable can be hammered.

The surprising discovery was made that, by hammering the core strand, the breaking strength of the wire cable can be considerably increased. This is attributable to the fact that, by means of the hammering, elevations on the surface of the core strand, which are produced as a result of the forming of the wires and possibly of the stranded core wires forming the core strand, can be deformed in such a way that, when seen in cross section, the external contours of the core strand approximate a circle. The surface of the core strand can thus be made very smooth, so that a large contact surface is produced in the wire cable between the core strand the multiwire strands. As a result, the pressures which are applied at the points where the wires of the multiwire strands rest on the surface of the core strand are relatively low. The danger of the formation of notches in the wires of the core strand and in the multiwire strands and thus the associated danger of breakage of the wire cable is reduced. This danger is especially great in cases where the finished, twisted wire cable is compacted by hammering, for example, because the hammering presses the multiwire strands onto the surface of the core strand, which considerably increases the likelihood of notch formation.

Because it is the core strand which is hammered, furthermore, wire cables of larger metal cross sections can be produced.

There are various ways of implementing the method. According to one of these variants, the core strand is hammered a certain distance away from the twisting point where wires and/or multiwire core strands are twisted around it, this distance being such that, with respect to their helical arrangement in the core strand, the wires and/or multiwire core strands have already assumed a fixed position in the longitudinal direction of the core strand. According to another variant, the core strand is hammered directly downstream of the twisting point.

In the first variant, the diameter of the core strand is reduced. In addition, the wires or multiwire core strands are compressed in the longitudinal direction. This occurs because the wires or strands are arranged in helical fashion on the core strand; and, as a result of the hammering, they are deformed into a helix of smaller diameter, in which the lengths of wire or of multiwire strand needed to form the helix are reduced. As a result, the wires or multiwire core strands are arranged more loosely; that is, they no longer rest against each other with the same tension as that present immediately after the twisting step and before the hammering. The exact degree of looseness depends on, among other things, the degree of compaction achieved by the hammering and on the selected lay length. This looser arrangement offers the advantage that the wire cable comprises greater flexibility and thus greater bending strength. It is obvious that the degree of looseness of the arrangement of the wires or of the multiwire core strands should not be so great that the wire cable, especially the core strand, no longer has sufficient stability.

In the case of this variant, the core strand can be compacted first, preferably by means of a roll compactor or a draw plate, and then hammered.

To implement the method according to the first variant, a device is provided, which comprises a compacting device comprising hammers, which are provided to strike the surface of the wire strand. Advisably several, preferably three, hammers are provided, which together completely surround the core strand at the time of impact, and the size of which is adapted to the core strand diameter to be obtained.

To implement the method according to the first variant, the device comprises a mechanism for twisting the wires or multiwire core strands, and the hammers are arranged in the device in such a way that they strike the core strand a certain distance away from the twisting point, i.e., at a distance such that the wires or multiwire core strands have assumed their permanent positions in the helix in the longitudinal direction of the core strand.

The compacting mechanism can comprise the previously mentioned draw plate or the previously mentioned roll compactor, which, with respect to the twisting direction, is arranged upstream of the hammers.

In the case of the second variant, in which the core strand is hammered directly downstream from the twisting point, the wires or multiwire core strands become arranged in the core strand in a way which differs from that of the first variant. Because, in contrast to the first variant, they are hammered before they have assumed their permanent positions in the helix in the longitudinal direction of the core strand, only the lengths of the wires or multiwire core strands actually required to form the core strand are twisted during the twisting step. As a result, the above-described compression and the associated loose arrangement in the core strand are avoided. The core strand can thus be produced with fewer internal stresses, and its metal cross section can be larger than that obtained by the method according to the first variant, but it has less flexibility than the core strand produced according to the first variant.

To implement the method according to the second variant, the hammers are arranged in the device in such a way that, during the hammering process, they strike the core cable directly downstream from the twisting point.

In an especially preferred embodiment of the invention, a plastic layer is applied to the core strand before the multiwire strands are twisted on, and the multiwire strands are pressed into the plastic layer, wherein the plastic layer is preferably softened. To form the plastic layer, a thermoplastic material is advisably used, and the plastic layer is heated to soften it. As a result, the support surface between the multiwire strands and the core strand is increased even more, and thus the danger of notch formation is even further decreased.

The multiwire strands are advisably preformed by means of a gauge or a preforming head before they are twisted to form the wire cable or the core strand.

The method has been found to offer the particular advantage that a wire cable with little or no tendency to rotate can be obtained by twisting the multiwire strands in the opposite direction to the wires or stranded core wires of the core strand. When the strands are arranged in this way, very high local forces develop at the points where the wires of the core strand and the multiwire strands cross; because of the increase in the size of the contact surface produced by the hammering, however, these forces are reduced.

In another embodiment of the invention, the wire cable is hammered after the multiwire strands have been twisted on; this is done for the purpose of increasing the metal cross section of the cable and of providing the wire cable with a smooth surface. To this end, the production device is provided with hammers, which can be arranged at the various previously mentioned distances from a twisting point at which the previously mentioned multiwire strands of the wire cable are twisted together with the core strand.

The invention is explained in greater detail below on the basis of exemplary embodiments and drawings, which refer to these examples:

DETAILED DESCRIPTION OF THE INVENTION

Figure 1:
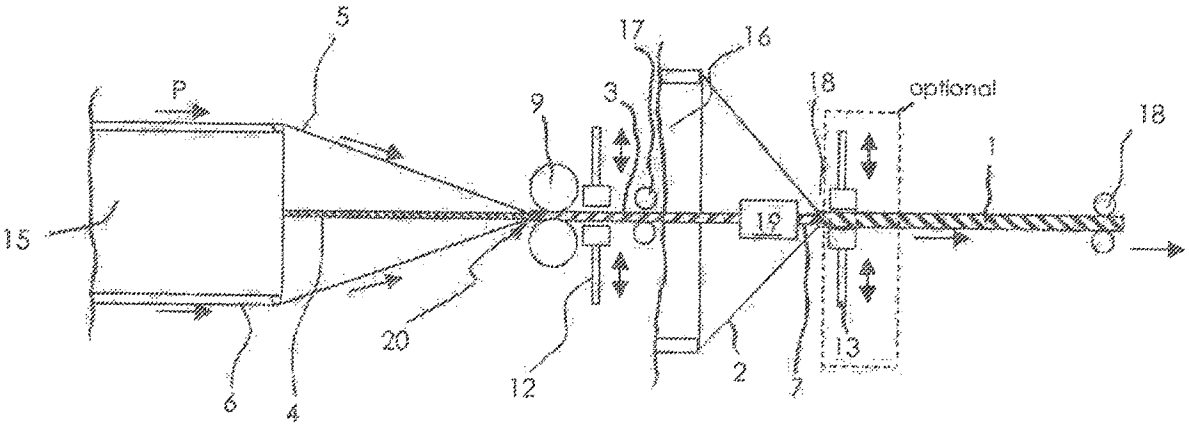
FIG. 1 shows a device according to the invention for the production of a wire cable.

A device according to the invention as shown in FIG. 1 has a twisting basket 15, over which outer multiwire core cable strands 5, 6 are guided in rotating fashion to a twisting point 20, where the outer multiwire core cable strands 5, 6 are wound around a multiwire heart strand 4 to form jointly a core cable 3, which is provided for a wire cable 1.

Downstream, with respect to the twisting direction, from the twisting point 20, a roll compactor 9 is arranged, by means of which the core cable 3, formed out of the multiwire heart strand 4 and the outer multiwire core strands 5, 6, is precompacted. Downstream from the roll compactor 9, hammers 12 are provided, which strike the core cable 3 simultaneously to smooth its surface and to compact it even more. The hammers 12 (not shown in detail) comprise circular concavities, which are adapted in their shape to the cross-sectional form of the core cable to be approximated by the hammering.

Downstream from the hammers 12, traction rolls 17 are provided in the device, by means of which the core cable 3 is first conveyed to a coating unit 19, where the core cable 3 is coated with a plastic layer 7 of thermoplastic material. After that, a twisting device comprising a twisting basket 16 is used to twist the core cable 3 together with outer multiwire cable strands 2 at a second twisting point 18. During the twisting process, the outer multiwire strands are pressed into the plastic layer 7, which may still be soft after its application to the core cable 3, or it may have been heated by a heating device (not shown) to soften it; the wires are pressed in so far that they rest on the core cable 3. Optionally, the device can be provided with the hammers 13, shown in a box in broken outline, by means of which the wire cable formed out of the core cable 3 and the outer multiwire strands 3 can be subjected to further hammering to compact it and to smooth its surface.

Figure 4:
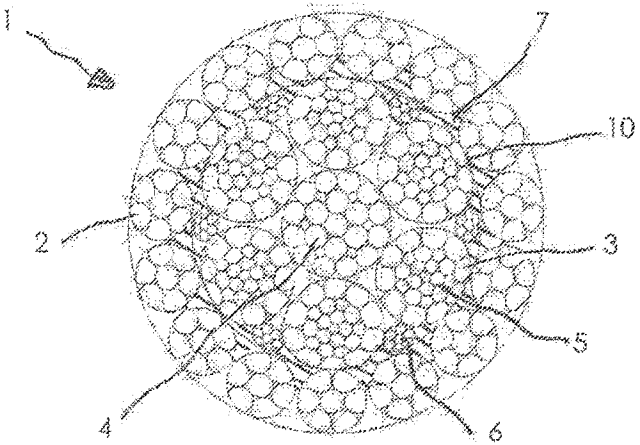
FIG. 4 shows a cross section of a wire cable according to the invention.

As can be seen in FIG. 4, which shows a wire cable 1 produced by means of the device according to FIG. 1, the external contour of the core cable 3 has been smoothed by the hammering treatment with the hammers 12, so that it approximates the form of a circle. The plastic layer 7 is provided in the area between the core cable 3 and the outer multiwire cable strands 2.

The wire cable 1 shown has not been processed by the hammers 13, so that the outer multiwire cable strands 2 still have their original round shape. In comparison to a wire cable with a core cable which has not been hammered, the wire cable 1 comprises a much higher breaking strength and a much greater elongation at break.

Figure 2:
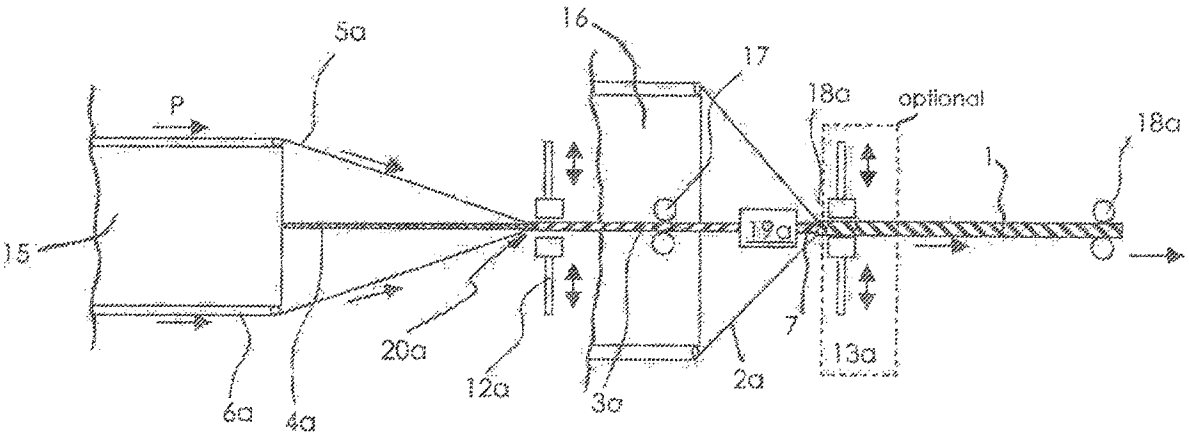
FIG. 2 shows another device according to the invention for the production of a wire cable.

Another device according to the invention, shown in FIG. 2, differs from that according to FIG. 1 in that hammers 12*a* are arranged directly downstream from a twisting point 20*a*, where the multiwire heart strand 4*a* is twisted together with the outer multiwire core strands 5*a*, 6*a* to form a core cable 3. In the same way, hammers 13*a*, provided only as an option in this case, are arranged directly downstream from the twisting point to process a wire cable la consisting of the core cable 3*a* onto which the outer multiwire cable strands 2*a* have been twisted at a twisting point 18*a*.

Figure 3:
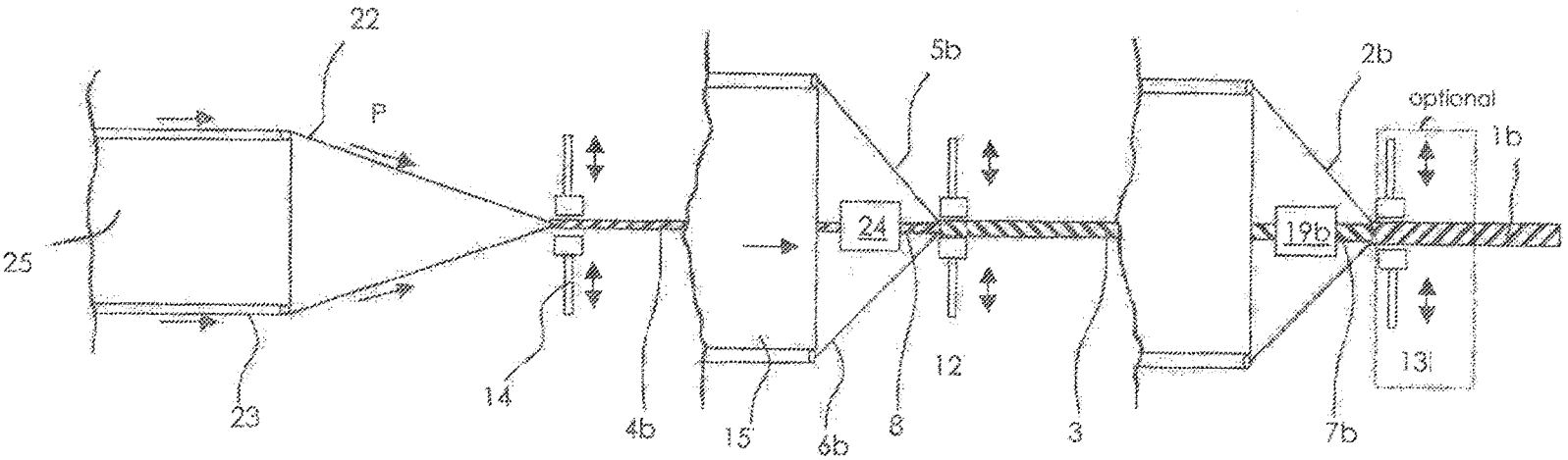
FIG. 3 shows another device according to the invention for the production of a wire cable.

Another device according to the invention, shown in FIG. 3, differs from those according to FIGS. 1 and 2 in particular in that additional hammers 14 are provided to process the multiwire heart strand 4*b*, produced from wires 22, 23 by means of a twisting mechanism 25. The device also comprises a coating unit 24 for coating the multiwire heart strand 4*b* with a plastic layer 8. Optionally, it is also possible here to provide a heating device (not shown) for the plastic layer 8, so that the multiwire core strands 6*b* can be pressed into the softened thermoplastic material forming the plastic layer 8 as they are being twisted onto the multiwire heart strand 4*b*.

Figure 5:
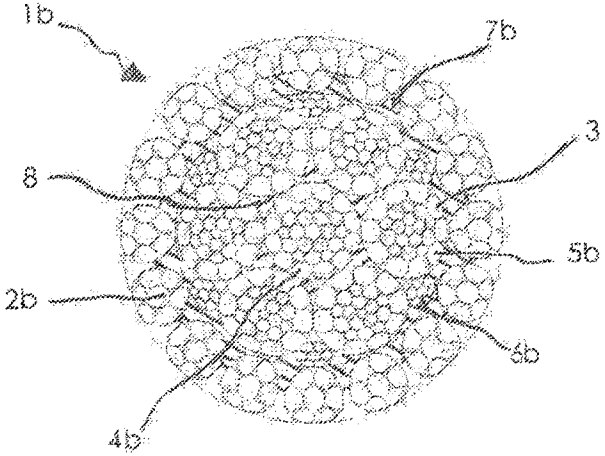
FIG. 5 shows a cross section of another wire cable according to the invention.

A wire cable 1*b* produced by means of the device according to FIG. 3, which cable comprises the hammered multiwire heart strand 4*b* and the hammered multiwire core strands 5*b*, 6*b* as well as hammered multiwire strands 2*b*, is shown in cross section in FIG. 5. The wire cable 1*b* comprises a breaking strength and elongation at break which are even greater than those of the wire cable 1 according to FIG. 4.

In additional exemplary embodiments (not shown), the devices according to FIGS. 1-3 are not provided with the coating units 19, 19*a*, 19*b*, or 24, and the wire cables are thus produced by the associated methods without a plastic layer.

The wire cables produced by means of the device or method according to the invention then comprise, accordingly, the cross sections shown in FIGS. 4 and 5 but without the plastic layer.

The invention claimed is:

1. A method for producing a wire cable, comprising the steps of: precompacting a core cable and afterwards compacting the core cable by hammering to smooth an outer surface of the core cable and increase flexibility and bending strength of the wire cable; applying a plastic layer to the core cable; softening the plastic layer; subsequently twisting multiwire strands onto the core cable covered by the softened plastic layer and pressing the multiwire strands into the softened plastic layer; and hammering the wire cable after the multiwire strands are twisted on the core cable and pressed into the plastic layer.

2. The method according to claim 1, wherein the core cable is precompacted by a roll compactor or a draw plate.

3. A wire cable, comprising: a core cable precompacted and subsequently compacted by hammering to smooth an outer surface of the core cable and increase flexibility and bending strength of the wire cable; a plastic layer applied on the core cable; and multiwire strands twisted onto the core cable and pressed into the plastic layer, wherein the wire cable is hammered after the multiwire strands are twisted onto the core cable and pressed into the plastic layer.

4. A method for producing a wire cable, comprising the steps of: twisting wires at a twisting point into a core strand; hammering the core strand for increasing flexibility and bending strength of the wire cable at a certain distance away from the twisting point, the certain distance being such that, with respect to a helical arrangement in the core strand, the wires have already assumed a fixed position in a longitudinal direction of the core strand and are deformed into a helix of smaller diameter, in which lengths of wire or of multiwire strand needed to form the helix are reduced; and subsequently twisting multiwire strands on the core strand and subsequently hammering the wire cable after the multiwire strands are twisted onto the core strand.

5. A wire cable, comprising: a core strand formed of twisted wires at a twisting point, the core strand being hammered for increased flexibility and bending strength of the wire cable and for smoothening an outer surface of the core strand, wherein the core strand is hammered in a certain distance away from the twisting point, the certain distance being such that, with respect to a helical arrangement in the core strand, the wires have already assumed a fixed position in a longitudinal direction of the core strand and are deformed into a helix of smaller diameter, in which lengths of wire or of multiwire strand needed to form the helix are reduced; and multiwire strands twisted onto the core strand, wherein the wire cable is hammered after twisting of the muitiwire strands onto the core strand.

* * * * *